United States Patent [19]

Scherzer

[11] Patent Number: 4,588,496

[45] Date of Patent: May 13, 1986

[54] PROCESS FOR THE CATALYTIC CRACKING OF METALS-CONTAINING FEEDSTOCKS

[75] Inventor: Julius Scherzer, Anaheim, Calif.

[73] Assignee: Union Oil Company of California, Los Angeles, Calif.

[21] Appl. No.: 688,567

[22] Filed: Jan. 3, 1985

[51] Int. Cl.[4] ..... C10G 11/05

[52] U.S. Cl. ..... 208/120; 502/67; 502/79

[58] Field of Search ..... 208/120 MC, 74, 120; 502/67, 79

[56] References Cited

U.S. PATENT DOCUMENTS

| | | | |
|---|---|---|---|
| 3,506,400 | 4/1970 | Eberly, Jr. et al. | 502/79 |
| 3,556,988 | 1/1971 | Stover et al. | 208/120 MC |
| 3,591,488 | 7/1971 | Eberly, Jr. et al. | 208/120 |
| 3,640,681 | 2/1972 | Pickert | 208/120 |
| 3,944,482 | 3/1976 | Mitchell et al. | 208/120 |
| 4,093,560 | 6/1978 | Kerr et al. | 502/79 |
| 4,097,410 | 6/1978 | Gladrow | 208/120 MC |
| 4,100,108 | 7/1978 | Alafandi et al. | 502/67 |
| 4,115,251 | 9/1978 | Flanders et al. | 208/120 MC |
| 4,218,307 | 8/1980 | McDaniel | 208/120 |
| 4,415,438 | 11/1983 | Dean et al. | 502/79 |
| 4,442,223 | 4/1984 | Chester et al. | 208/120 MC |
| 4,477,336 | 10/1984 | Scherzer | 208/120 |
| 4,480,047 | 10/1984 | Beck et al. | 502/79 |
| 4,503,023 | 3/1985 | Breck et al. | 423/328 |
| 4,515,683 | 5/1985 | Beck et al. | 208/113 |
| 4,534,853 | 8/1985 | Long et al. | 208/120 |

FOREIGN PATENT DOCUMENTS

| | | |
|---|---|---|
| 0082211 | 6/1983 | European Pat. Off. . |
| 0109064 | 5/1984 | European Pat. Off. . |

*Primary Examiner*—John Doll
*Assistant Examiner*—Lance Johnson
*Attorney, Agent, or Firm*—Yale S. Finkle; Gregory F. Wirzbicki; Dean Sandford

[57] ABSTRACT

Hydrocarbon feedstocks containing relatively high levels of metal contaminants, such as nickel and vanadium, are converted via catalytic cracking into products of lower average molecular weight by contacting the feedstock with a catalyst comprising a (1) porous, inorganic refractory oxide component and (2) a dealuminated Y zeolite having a silica-to-alumina mole ratio above about 6.0. The dealuminated Y zeolite is preferably prepared by contacting an ammonium-exchanged Y zeolite having a silica-to-alumina mole ratio below about 6.0 with an aqueous solution of ammonium hexafluorosilicate. The refractory oxide component will preferably contain alumina and a clay such as kaolin. The catalyst may also contain a nondealuminated Y zeolite, preferably one that has been ion exchanged with rare earth cations. Typically, the hydrocarbon feedstock will contain contaminant metals in sufficient quantities such that their concentration exceeds about 4.0 ppmw Nickel Equivalents.

27 Claims, 3 Drawing Figures

PROCESS FOR THE CATALYTIC CRACKING OF METALS-CONTAINING FEEDSTOCKS

BACKGROUND OF THE INVENTION

This invention relates to a catalytic cracking process and is particularly concerned with converting high molecular weight hydrocarbon feedstocks that contain substantial quantities of metal contaminants to lower molecular weight products utilizing a metals tolerant cracking catalyst.

Fluidized catalytic cracking (FCC) units are used in the petroleum industry to convert high boiling hydrocarbon feedstocks to more valuable hydrocarbon products, such as gasoline, having a lower average molecular weight and a lower average boiling point than the feedstocks from which they were derived. The conversion is normally accomplished by contacting the hydrocarbon feedstock with a moving bed of catalyst particles at temperatures ranging between about 800° F. and about 1100° F. The most typical hydrocarbon feedstock treated in FCC units comprises a heavy gas oil, but on occasions such feedstocks as light gas oils, naphthas, reduced crudes and even whole crudes are subjected to catalytic cracking to yield low boiling hydrocarbon products.

Catalytic cracking in FCC units is generally accomplished by a cyclic process involving separate zones for catalytic reaction, steam stripping, and catalyst regeneration. The hydrocarbon feedstock is blended with an appropriate amount of catalyst particles to form a mixture that is then passed to a catalytic reactor, normally referred to as a riser, wherein the mixture is subjected to a temperature between about 800° F. and about 1100° F. in order to convert the feedstock into gaseous, lower boiling hydrocarbons. After these lower boiling hydrocarbons are separated from the catalyst in a suitable separator, such as a cyclone separator, the catalyst, now deactivated by coke deposited upon its surfaces, is passed to a stripper. Here the deactivated catalyst is contacted with steam to remove entrained hydrocarbon vapors that are then combined with the vapors exiting the cyclone separator to form a mixture that is passed downstream to other facilities for further treatment. The coke-containing catalyst particles recovered from the stripper are introduced into a regenerator wherein the catalyst is reactivated by combusting the coke in the presence of an oxygen-containing gas such as air. The cyclic process is then completed by blending the reactivated catalyst particles with feedstock entering the riser of the FCC unit.

There has recently been a strong trend in the petroleum industry toward the use of higher molecular weight hydrocarbons, such as resids, as feeds to FCC units. A common problem arising from the use of such feedstocks is that they normally contain relatively high concentrations of metals, such as nickel, vanadium, iron and copper, which tend to deposit on the catalyst during cracking operations, thereby gradually reducing the activity and selectivity of the cracking catalyst. These metals are normally present in the form of organometallic compounds, such as porphyrins and asphaltenes (where the metals are coordinated to heteroatom elements). Some of the metal contaminants which deposit on the catalyst, such as nickel constituents, deleteriously affect selectivity by increasing the production of hydrogen, light gases and coke. Other metal contaminants, such as vanadium, decrease activity by destroying the zeolite portion of the catalyst. The higher levels of coke which deposit on the catalyst when treating a feedstock containing a relatively large concentration of metals result in the need for more efficient regeneration, which is often accomplished by increasing the temperature in the regenerator. The regenerator temperature, however, is limited by, among other factors, the thermal stability of the catalyst, primarily by the stability of the zeolite in the catalyst.

Accordingly, it is one of the objects of the present invention to provide a fluid catalytic cracking process for treating metals-containing feedstocks which utilizes a catalyst that retains high activity and selectivity. It is another object of the invention to provide a catalytic cracking process in which the catalyst contains a zeolite of enhanced thermal and hydrothermal stability and therefore can be subjected to higher than normal regeneration temperatures. These and other objects of the invention will become more apparent in view of the following description of the invention.

SUMMARY OF THE INVENTION

In accordance with the invention, it has now been found that catalysts comprising a porous, inorganic refractory oxide component and a dealuminated Y zeolite having a silica-to-alumina mole ratio above about 6.0 are hydrothermally stable and retain their activity and selectivity during use in the catalytic cracking of hydrocarbon feedstocks having a high metals content. The Y zeolites that may be used in the catalyst are prepared by dealuminating a Y zeolite having a silica-to-alumina mole ratio below about 6.0. The most preferred dealuminated Y zeolite is prepared by contacting an ammonium-exhanged Y zeolite with an aqueous solution of ammonium hexafluorosilicate. The porous, inorganic refractory oxide component is normally selected from the group consisting of silica-alumina, alumina, silica, and natural and synthetic clays. The most preferred refractory oxide component comprises a mixture of alumina and kaolin and is present in such quantities that the alumina comprises more than about 30 weight percent of the catalyst.

In general, the feedstock to the catalytic cracking process in which the above-described catalyst is used will contain greater than about 4.0 ppmw Nickel Equivalents. The phrase "Nickel Equivalents" as used herein is defined as follows: Nickel Equivalents (ppmw)=Ni (ppmw)+V/4 (ppmw)+Fe/7.1 (ppmw)+Cu/1.2 (ppmw). Typically, the feed will be an unhydrotreated oil containing above about 70 volume percent components boiling above about 650° F.

DETAILED DESCRIPTION OF THE INVENTION

Figure 1:
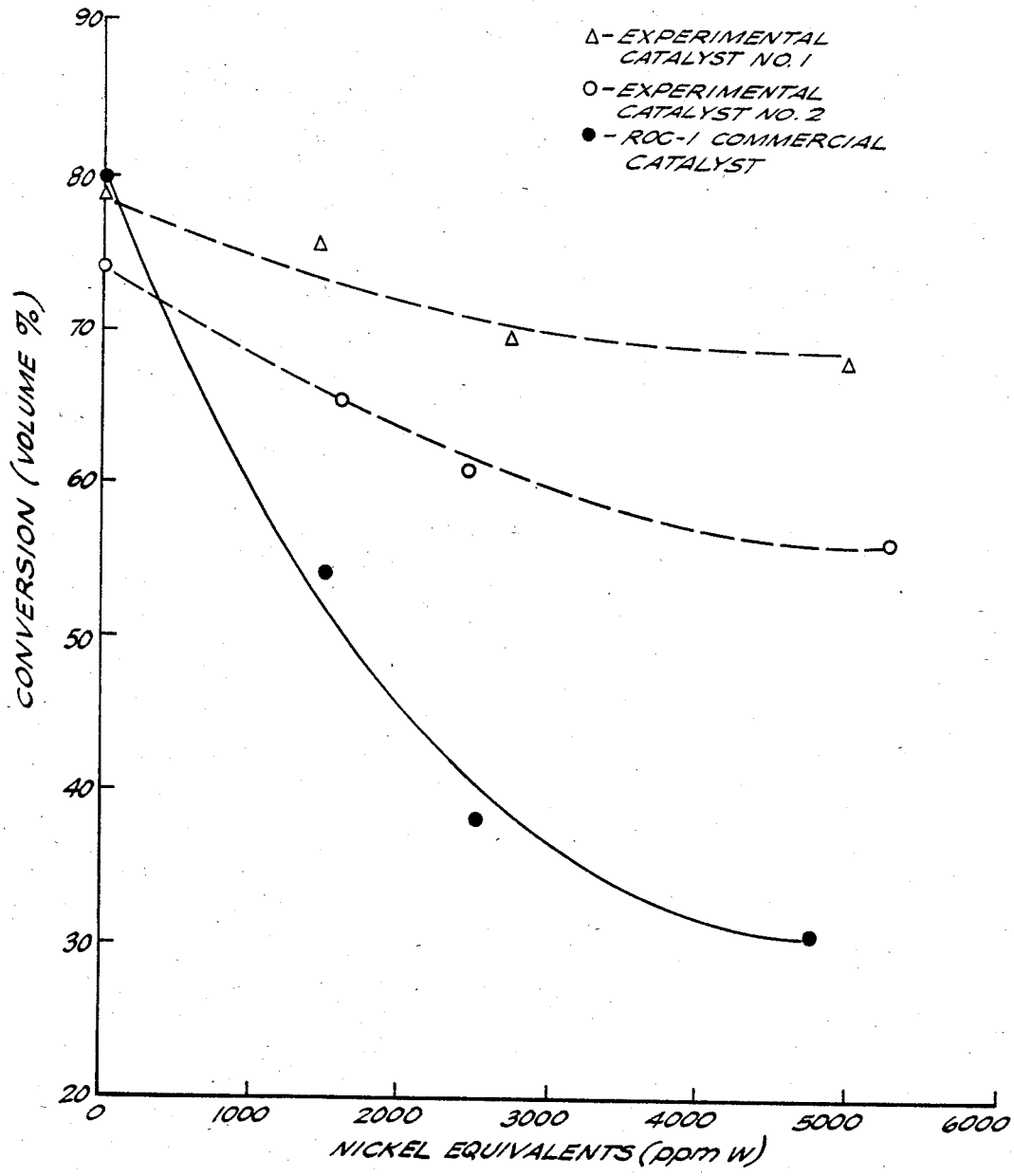
FIG. 1 in the drawing is a plot comparing the conversion obtained in a catalytic cracking process utilizing experimental catalysts containing varying concentrations of nickel and vanadium to the conversion obtained utilizing a commercially available catalyst containing similar concentrations of nickel and vanadium.

In accordance with this invention, catalysts comprising an intimate mixture of a dealuminated Y zeolite and a porous, inorganic refractory oxide component, such as silica-alumina, alumina, silica, and natural and synthetic clays, are used in a fluidized catalytic cracking process or other cyclic catalytic cracking process carried out in the substantial absence of added molecular hydrogen in which a metals-containing hydrocarbon feedstock is refined to produce low-boiling hydrocarbon products by passage through a catalytic cracking reaction zone. The dealuminated Y zeolite is prepared from a crystalline aluminosilicate zeolite of the Y-type having a silica-to-alumina mole ratio below about 6.0. Normally, the Y zeolite starting material will be in the sodium form, containing between about 10 weight percent and about 14 weight percent sodium calculated as $Na_2O$. U.S. Pat. No. 3,130,007, the disclosure of which is hereby incorporated by reference in its entirety, describes Y-type zeolites having a silica-to-alumina mole ratio between about 3.0 and about 6.0, with a typical Y zeolite having a silica-to-alumina mole ratio of about 5.0.

The dealuminated Y zeolite used in the cracking catalyst will have a silica-to-alumina mole ratio above about 6.0, preferably between about 6.1 and about 15.0. The most highly preferred dealuminated Y zeolite will have a silica-to-alumina mole ratio between about 6.1 and about 10.0. Such zeolites are usually prepared from a Y zeolite starting material and will thus have the essential X-ray powder diffraction pattern of Y zeolite. It will be understood, however, that in converting a Y zeolite starting material to a dealuminated zeolite useful in the present invention, the resulting dealuminated zeolite may not have exactly the same X-ray powder diffraction pattern for Y zeolites as is disclosed in U.S. Pat. No. 3,130,007. The d-spacings may be shifted somewhat due to a shrinkage in the unit cell size which is due to the increase in the silica-to-alumina mole ratio. The essential crystal structure of Y zeolite will, however, be retained so that the essential X-ray powder diffraction pattern of the dealuminated zeolite used in the cracking catalyst will be consistent with that of either Y zeolite itself or a Y zeolite of reduced unit cell size. Normally, the unit cell size for the dealuminated Y zeolite used in the catalyst will be below 24.65 Angstroms.

The dealuminated Y zeolites used in the catalyst may be prepared by any conventional method of dealumination as long as the overall silica-to-alumina mole ratio, as opposed to the framework silica-to-alumina mole ratio, of the Y zeolite starting material is increased in value from below about 6.0 to above about 6.0. There are three general methods for preparing dealuminated Y zeolites. One of these methods, hydrothermal treatment, increases the framework silica-to-alumina mole ratio but not the overall silica-to-alumina mole ratio. The other two methods, chemical treatment and a combination of hydrothermal and chemical treatment, increase both the overall and framework silica-to-alumina mole ratio. Hydrothermal dealumination involves calcination of the ammonium or hydrogen form of the Y zeolite starting material at relatively high temperatures, typically above about 900° F., in the presence of steam. This treatment results in the expulsion of tetrahedral aluminum from framework into nonframework positions, but normally does not remove the aluminum from the zeolite and therefore does not increase the overall silica-to-alumina mole ratio of the starting Y zeolite. Thus, chemical treatment and a combination of hydrothermal and chemical treatment are the methods that are typically used to prepare the dealuminated Y zeolites that comprise the cracking catalysts used in the process of the invention.

Chemical dealumination is achieved by reacting the starting Y zeolite with a suitable reagent in an aqueous or nonaqueous solution or by reacting the zeolite with a reagent in the vapor phase at a high temperature. Dealumination in solution is normally accomplished by reacting the zeolite with solutions of acids, salts, or chelating agents. The combination of thermal and chemical dealumination is typically a two-step method used to obtain a higher degree of dealumination. The mechanism during the thermal treatment step is similar to the one described above for thermal dealumination. High temperatures and steam enhance the expulsion of aluminum from the framework. The chemical treatment then involves the solubilization primarily of nonframework aluminum generated during the thermal treatment step. The nonframework aluminum can be in the form of cationic and neutral species, the amount and composition of which depend upon the conditions of the thermal treatment. Specific methods of thermal and chemical dealumination are described in detail in the article entitled "The Preparation and Characterization of Aluminum Deficient Zeolites" appearing in *Catalytic Materials: Relationship Between Structure and Reactivity,* ACS Symposium Series 248, 1984, the disclosure of which article is hereby incorporated by reference in its entirety.

The preferred zeolite for use in the cracking catalyst is known as LZ-210, a zeolitic aluminosilicate molecular sieve available from the Linde Division of the Union Carbide Corporation. This zeolite is described in detail in European Patent Application No. 81110629.3 filed on Dec. 20, 1981 and published on June 29, 1983 as EP O No. 082211 A1, the disclosure of which is hereby incorporated by reference in its entirety. LZ-210 zeolite has an X-ray powder diffraction pattern consistent with a Y zeolite of reduced unit cell size and may be prepared, for example, so as to have an X-ray powder diffraction pattern falling in the ranges set forth in Table 1 below.

TABLE 1

| d (Angstroms) | Intensity |
|---|---|
| 14.7–13.97 | very strong |
| 8.68–8.55 | medium |
| 7.40–7.30 | medium |
| 5.63–5.55 | medium |
| 4.72–4.66 | strong |
| 4.34–4.28 | medium |
| 3.74–3.69 | strong |
| 3.28–3.23 | strong |
| 2.83–2.79 | strong |

LZ-210 zeolites are conveniently prepared from a Y zeolite starting material in silica-to-alumina mole ratios between about 6.0 and about 15, although higher ratios are possible. Preferred LZ-210 zeolites have a silica-to-alumina mole ratio of about 6.1 to about 10.0. Typically, the unit cell size is at or below 24.65 Angstroms and will, normally range between about 24.40 and about 24.65 Angstroms. LZ-210 zeolites having a silica-to-alumina mole ratio below 20 generally have a sorptive capacity for water vapor at 25° C. and 4.6 mm mercury water vapor partial pressure of at least 20 weight percent based on the anhydrous weight of the zeolite. Normally, the oxygen sorptive capacity at 100 mm mercury and −183° C. will be at least 25 weight percent.

LZ-210 zeolites are resistant to crystal collapse at elevated temperatures. These zeolites are stable in dry air at temperatures of at least 975° C., and are most often stable at a temperature of at least 1035° C. This resistance to crystal collapse compares favorably with a typical sodium Y zeolite that is ion-exchanged with ammonium ions and which collapses at a temperature of about 861° C.

In general, LZ-210 zeolites may be prepared by dealuminating conventional Y zeolites using an aqueous solution of a fluorosilicate salt, preferably a solution of ammonium hexafluorosilicate. The dealumination is accomplished by placing an ammonium-exchanged Y zeolite into an aqueous reaction medium such as an aqueous solution of ammonium acetate, and slowly adding an aqueous solution of ammonium hexafluorosilicate. After allowing the reaction to proceed, a zeolite having an increased silica-to-alumina mole ratio is produced. The magnitude of the increase is dependent at least in part on the amount of fluorosilicate solution contacted with the zeolite and on the reaction time allowed. Normally, a reaction time of between about 10 and about 24 hours is sufficient for equilibrium to be achieved. The resulting solid product, which may be separated from the aqueous reaction medium by conventional filtration techniques, is a form of LZ-210 zeolite. In some cases this product may be subjected to a steam calcination by contacting the product with water vapor at a partial pressure of at least 0.2 p.s.i.a. for a period of between about ¼ to about 3 hours at a temperature between about 900° F. and about 1500° F. in order to provide greater crystalline stability.

If the LZ-210 zeolite or other dealuminated Y zeolite to be used in the cracking catalyst contains a large amount of sodium, it is normally desired to ion-exchange the dealuminated zeolite with ammonium ions, polyvalent metal cations, such as rare earth-containing cations, or a combination of both to lower the sodium content until it is less than about 0.8 weight percent, preferably less than about 0.5 weight percent and most preferably less than about 0.3 weight percent, calculated as $Na_2O$. If ammonium ions are used, the ion-exchange is ordinarily carried out such that at least 25 percent, often at least 50 percent, of the residual zeolitic sodium ions in the dealuminated zeolite are exchanged with ammonium ions. The ammonium ion exchange is carried out by mixing the dealuminated zeolite with an aqueous solution containing a dissolved ammonium salt, such as ammonium nitrate, ammonium sulfate, ammonium chloride, and the like. The resulting slurry is stirred for between about 1 and about 5 hours at temperatures above ambient but less than about 100° C. If sodium levels below 0.3 weight percent are desired, the ion exchange procedure will ordinarily have to be repeated at least once. Normally, the ion exchange procedure will be repeated at least twice and occasionally several times before a reduction in sodium content below 0.3 weight percent is achieved.

The ammonium-exchanged and/or rare earth-exchanged LZ-210 zeolite or other dealuminated Y zeolite prepared as described above is combined with a porous, inorganic refractory oxide component to form a finished catalyst prior to use. The refractory oxide component in the finished catalyst may be silica-alumina, silica, alumina, natural or synthetic clays, mixtures of one or more of these components and the like. Preferably, the inorganic refractory oxide component or matrix will comprise a mixture of alumina and a clay such as kaolin. A preferred finished catalyst will typically contain between about 5 weight percent and about 40 weight percent dealuminated zeolite and greater than about 30 weight percent alumina. In general, the finished catalyst will contain between about 10 weight percent and about 35 weight percent dealuminated zeolite, between about 25 weight percent and about 40 weight percent alumina, and between about 25 weight percent and about 65 weight percent clay. It is normally preferred that the refractory oxide component contains a large proportion of alumina since it is believed that metals in the feedstock to the catalytic cracking unit will preferentially deposit into the alumina rather than on the zeolitic component, thereby prolonging the useful life of the catalytically active zeolite component.

In some instances it may be desirable for the finished catalyst to contain a nondealuminated or conventional Y zeolite in addition to the dealuminated zeolite. The nondealuminated zeolite used may be any conventional Y zeolite including stabilized hydrogen Y zeolites and zeolites that have been ion exchanged with polyvalent metal cations such as rare earth-containing cations. The nondealuminated zeolite will normally have a silica-to-alumina mole ratio below about 6.0. When it is desired to utilize a nondealuminated Y zeolite in addition to the dealuminated Y zeolite, the finished catalyst will normally contain between about 10 weight percent and about 30 weight percent of the dealuminated Y zeolite and between about 5 weight percent and about 20 weight percent of the nondealuminated zeolite, preferably between about 5 weight percent and about 15 weight percent. As in the case when only a dealuminated Y zeolite is present, the porous, inorganic refractory oxide component will preferably contain greater than about 30 weight percent alumina in addition to a clay such as kaolin. The most preferred ranges of alumina and clay content will be the same as those for a finished catalyst which contains a dealuminated Y zeolite and no conventional Y zeolite.

The dealuminated Y zeolite, and when desired the nondealuminated Y zeolite, may be combined with the porous, inorganic refractory oxide component or a precursor thereof by techniques including mixing, mulling, blending, or homogenization. Examples of precursors that may be used include alumina, alumina sols, silica sols, alumina hydrogels, and peptized alumina. A preferred precursor for use in preparing a finished catalyst of relatively high stability is a nonacidic alumina sol. Normally, acidic alumina sols are not preferred since the stability of the resultant catalyst is lower than desired. In a preferred method of preparing the cracking catalyst, the dealuminated zeolite is combined with a nonacidic alumina sol or other inorganic refractory oxide component and the resultant mixture is spray dried to produce finished catalyst particles normally ranging in size between about 40 microns and about 80 microns. If desired, however, the dealuminated zeolite may be mulled or otherwise mixed with the refractory oxide component or precursor thereof, extruded and then ground into the desired particle size range. Normally, the finished catalyst will have an average bulk density between about 0.7 gram/cm$^3$ and about 0.95 gram/cm$^3$ and a pore volume between about 0.15 cm$^3$/gram and about 0.35 cm$^3$/gram.

It has been found that the above-described catalysts have a very high tolerance to metals and are thus very effective for use in cracking feedstocks containing relatively high concentrations of metals such as nickel, vanadium, iron, copper, and the like. The accumulation of such metals on conventional cracking catalysts has many deleterious effects. For example, nickel tends to increase production of hydrogen, light gases and coke, thereby significantly lowering the yield of gasoline. Vanadium, on the other hand, tends to destroy the zeolitic component of the catalyst by forming fluxes therewith and lowering its melting point so that it begins to sinter and becomes ineffective as a cracking component. The accumulation of metals on the cracking catalyst can lead to a significant increase in volumes of unwanted gas and very quickly overload the gas compressors and gas recovery facilities associated with the catalytic cracking unit.

The hydrocarbon feed to FCC units utilizing conventional cracking catalysts will normally contain less than about 2.5 ppmw Nickel Equivalents, frequently less than about 1.5 ppmw Nickel Equivalents, most frequently less than about 0.25 ppmw. As pointed out earlier "Nickel Equivalents" as used herein is equal to Ni (ppmw)+V/4 (ppmw)+Fe/7.1 (ppmw)+Cu/1.2 (ppmw). The concentration of metals in the feedstock or on the catalyst is normally expressed in Nickel Equivalents instead of gross metals content because all metals are not equally effective in producing hydrogen, light gases and coke and therefore the gross metals content is not an accurate measure of contamination. On a weight basis, nickel and copper tend to be about four times as strong a contaminant as vanadium and about seven times as strong as iron. FCC unit feedstocks normally contain very low concentrations of copper, and iron, which is present due to corrosion and erosion of vessels and conduits, and these metals are therefore not considered to be significant catalyst contaminants. In general, conventional cracking catalysts are effective as long as the metal contaminant level on the catalyst is maintained in the range between about 200 and about 600 ppmw Nickel Equivalents. Refiners normally strive to maintain the metals content of the catalyst below about 1000 ppmw Nickel Equivalents. In general, conventional cracking catalysts become poisoned and ineffective for cracking and must be discarded when the metals content of the catalysts rises to above about 1500 ppmw Nickel Equivalents.

The catalysts described above which contain dealuminated zeolites have been found to be highly resistant to poisoning by metals in catalytic cracking feedstocks. In general, the catalysts are effective in treating any feedstock which has a metals content greater than about 4.0 ppmw Nickel Equivalents. They are especially effective for use when the metals content of the feed is above about 10 ppmw Nickel Equivalents, even above about 25 ppmw Nickel Equivalents. It has been found that these cracking catalysts remain effective catalysts even though the metals level on the catalyst itself exceeds about 5000 ppmw Nickel Equivalents expressed as metals on regenerated equilibrium catalyst. In general, the catalysts are effective when their metals content ranges between about 1000 ppmw and about 10,000 ppmw Nickel Equivalents, preferably between about 1500 ppmw and about 7500 ppmw Nickel Equivalents, most preferably between about 1500 ppmw and about 5000 ppmw Nickel Equivalents.

The hydrocarbon feedstocks that can be effectively processed using the cracking catalyst described above will generally include feedstocks containing relatively high concentrations of metals, at least about 70 volume percent components which boil above about 650° F., and greater than about 20 volume percent constituents boiling above about 1025° F. Such feedstocks typically contain heavy bottoms material such as tars, asphalts, asphaltenes and resins in which contaminant metals such as nickel and vanadium tend to accumulate. Examples of suitable feedstocks for the process of the invention include whole crudes, nondeasphalted crude oil resids, heavy gas oils boiling between about 650° F. and 1100° F., and atmospheric and vacuum distillation bottoms containing significant amounts of material boiling above 1150° F. Suitable feedstocks not only include petroleum derived fractions but also hydrocarbon oils derived from coal, shale, tar sands and similar hydrocarbon-containing solids. The feedstock may contain significant quantities, normally greater than about 0.5 weight percent, typically more than about 2.0 weight percent and even greater than about 4.0 weight percent, asphaltenes and other pentane insoluble materials.

The cracking catalysts described above which contain a dealuminated Y zeolite and greater than about 30 weight percent alumina have also been found to be effective as "gettering" agents for sulfur oxides. The effectiveness of these catalysts as "gettering" agents is believed to be due to their relatively high alumina content. When such catalysts are used in the process of the invention, the hydrocarbon feed may contain higher than normal quantities of organosulfur compounds. Normally, the feedstock may contain greater than 0.3 weight percent sulfur, typically between about 0.5 weight percent and about 2.0 weight percent. The affinity of the catalyst for removing sulfur oxides during the catalytic cracking process allows the catalyst to be used as an effective air pollution control agent.

The nature and objects of the invention are further illustrated by the following examples, which are provided for illustrative purposes only and not to limit the invention as defined by the claims. The examples demonstrate that a catalyst containing a dealuminated Y zeolite can be used to catalytically crack hydrocarbon feedstocks containing large amounts of metals without suffering significant losses in activity and selectivity.

EXAMPLE 1

An experimental catalytic cracking catalyst is prepared by placing 572 grams (dry basis) of nonpeptized Catapal alumina and 3020 ml. of water in a Cowles mixer and stirring intensely for 15 minutes. After stirring, 572 grams of Huber kaolin (dry basis) is added in the form of an aqueous slurry containing 67 weight percent solids to the Cowles mixer from a beaker. The beaker is rinsed with 1230 ml. of water and the resultant rinse solution is added to the mixer. The slurry in the mixer is stirred for 15 minutes. An ammonium-exchanged LZ-210 zeolite is then ground in a blender and 327 grams (dry basis) of the ground zeolite is added to the slurry in the Cowles mixer. The LZ-210 zeolite has a silica-to-alumina mole ratio of 9.0 and a residual sodium content, calculated as $Na_2O$, of less than 0.20 weight percent after ammonium exchange. After the LZ-210 zeolite is added to the slurry in the Cowles mixer, 163 grams (dry basis) of a rare earth-exchanged, calcined, and ammonium-exchanged LZ-Y-52 zeolite, a commercially available sodium Y zeolite manufactured by Union Carbide Corporation and having a silica-to-alumina mole ratio of about 5.0, is ground in a blender and added to the slurry. The rare earth and ammonium-exchanged zeolite contains 15.4 weight percent rare earth oxides, calculated as $RE_2O_3$, and a residual sodium content, calculated as $Na_2O$, of less than 0.35 weight percent after calcination and ammonium exchange. Sufficient water is added to the slurry of Catapal alumina, Huber kaolin, LZ-210 zeolite and rare earth-exchanged zeolite such that the slurry contains 25 weight percent solids. The slurry is then stirred in the Cowles mixer for 15 minutes. After stirring the slurry is subjected to spray drying to produce a finished catalyst. The composition and physical-chemical characteristics of this catalyst are set forth below in Table 2 under the heading "Experimental Catalyst No. 1" and compared to the properties of ROC-1 catalyst, a commercial catalyst manufactured by Filtrol Company and recommended for use in the catalytic cracking of high metals-containing resid feedstocks.

TABLE 2

| Catalyst Formulation | ROC-1 Commercial Catalyst | Experimental Catalyst No. 1 | Experimental Catalyst No. 2 |
|---|---|---|---|
| LZ-210 Zeolite (dealuminated), wt % | | 20 | 35 |
| Rare Earth Exchanged LZ-Y-52 Zeolite (nondealuminated), wt % | | 10 | — |
| Alumina, wt % | | 35 | 35 |
| Kaolin, wt % | | 35 | 30 |
| Overall Chemical Formulation | | | |
| $SiO_2$, wt % | 54.2 | 29.5 | 39.6 |
| $Al_2O_3$, wt % | 39.7 | 66.8 | 59.6 |
| $Na_2O$, wt % | 0.88 | 0.11 | 0.16 |
| $RE_2O_3$, wt % | 3.26 | 1.02 | — |
| LOI, wt % | 0.51 | 20.6 | 16.9 |
| Physical Properties | | | |
| Surface Area, $m^2/g$ | 283 | 332 | 387 |
| Apparent Bulk Density, g/cc | 0.77 | 0.81 | 0.72 |
| $N_2$—Pore Volume, cc/g | 0.20 | 0.24 | 0.22 |
| Nitrogen-Pore Radii Size (Distribution, Vol %) | | | |
| 200–300 Angstroms | 4.5 | 7.5 | 4.7 |
| 150–200 Angstroms | 3.5 | 3.7 | 2.8 |
| 100–150 Angstroms | 5.5 | 2.9 | 2.3 |
| 50–100 Angstroms | 14.1 | 4.1 | 5.1 |
| 25–50 Angstroms | 47.7 | 38.6 | 47.9 |
| 15–25 Angstroms | 24.6 | 43.2 | 37.2 |

The data in Table 2 show that experimental catalyst No. 1 has a lower rare-earth and sodium content and considerably more alumina than the ROC-1 commercial catalyst. Experimental catalyst No. 1 also has a higher apparent bulk density and $N_2$-pore volume. The pore size distributions indicate that experimental catalyst No. 1 has a significantly higher percentage of pores in the 200-300 Angstrom range.

The particulate catalyst produced by spray drying is sieved to produce a fraction of particles ranging in size between about 40 microns and about 140 microns. Between about 200 and 300 grams of this size material is then calcined at 595° C. for 2 hours. The resultant calcined catalyst and a portion of the ROC-1 commercial catalyst are then divided into several samples and each sample is impregnated with either vanadium alone or combinations of nickel and vanadium. The impregnation is accomplished by immersing each sample into solutions containing various amounts of vanadyl and nickel naphthanate dissolved in xylene. These solutions are prepared so that the concentration of vanadium in each solution is twice the concentration of nickel. Each metal impregnated sample is then dried at 150° C. for 2 hours and calcined at 540° C. for 3 hours. The various samples of experimental and commercial catalysts which have been impregnated with either vanadium or nickel and vanadium range in metals concentration between 1500 and 5000 ppmw Nickel Equivalents.[1] After calcination, each sample of metals impregnated catalyst and samples of catalyst containing no metals are deactivated for testing by treatment in 100 percent flowing steam at 1450° F. for 5 hours. The deactivated catalyst samples are then evaluated for cracking activity by use of the standard microactivity test method (MAT). A gas oil with an API gravity of 23.1° and containing about 30.0 volume percent components boiling below 650° F. and about 70 volume percent boiling below about 820° F. is cracked at a temperature of 950° F. The tests are carried out at a WHSV of 15.0 and at atmospheric pressure utilizing a catalyst-to-oil ratio of about 3.3. The gas oil contains 0.6 ppmw nickel, less than 0.2 ppmw vanadium, 8.0 ppmw iron and less than 1.0 ppmw copper. The results of these tests are set forth below in Table 3 under the headings "Experimental Catalyst No. 1" and "ROC-1 Commercial Catalyst". The data listed in Table 3 for conversion, gasoline yield and light cycle oil yield are also shown as plots in FIGS. 1 through 3.

[1] Since nickel and vanadium are the most common metal contaminants found in catalytic cracking feedstocks, only these two metals are impregnated on the catalyst samples and the concentration of these two metals only is considered in calculating the Nickel Equivalents for purposes of this Example 1 and Example 2.

TABLE 3

Effect of Metals Impregnation on Product Yields

| | Experimental Catalyst No. 1 | | | | | Experimental Catalyst No. 2 | | | | | ROC-1 Commercial Catalyst | | | | |
|---|---|---|---|---|---|---|---|---|---|---|---|---|---|---|---|
| Ni + (ppmw) | 0 | 2790 | 5100 | 9600 | 4600*** | 0 | 3100 | 4700 | 10200 | 4600*** | 0 | 3000 | 4900 | 9100 | 4600*** |
| Ni Equivalents* (ppmw) | 0 | 1440 | 2700 | 4950 | 1150*** | 0 | 1600 | 2450 | 5250 | 1150*** | 0 | 1500 | 2500 | 4750 | 1150*** |
| Conversion (Vol %) | 78.5 | 75.6 | 69.6 | 68.2 | 71.3 | 74.3 | 65.5 | 61.0 | 56.3 | 68.0 | 79.7 | 54.1 | 38.3 | 31.1 | 40.5 |
| Gasoline (Vol %) | 60.3 | 56.9 | 46.6 | 43.2 | 51.0 | 57.0 | 46.4 | 41.9 | 36.9 | 44.3 | 59.7 | 35.8 | 24.0 | 19.0 | 17.9 |
| Gasoline/Conver. | .768 | .752 | .669 | .633 | .715 | .767 | .708 | .687 | .655 | .651 | .749 | .662 | .626 | .611 | .442 |
| Coke (Weight %) | 6.9 | 11.5 | 15.4 | 17.4 | 13.5 | 5.9 | 11.1 | 12.4 | 14.6 | 13.5 | 6.8 | 7.2 | 9.2 | 9.8 | 7.7 |
| Coke/Conversion | .087 | .152 | .221 | .255 | .189 | .079 | .169 | .203 | .259 | .198 | .085 | .133 | .240 | .315 | .190 |
| Light Cycle Oil** (Vol %) | 16.8 | 18.8 | 22.9 | 23.7 | 22.3 | 19.4 | 24.4 | 27.3 | 31.1 | 23.1 | 16.0 | 27.2 | 33.4 | 35.6 | 30.5 |
| Hydrogen (SCF/B) | 190 | 666 | 925 | 1000+ | 851 | 216 | 717 | 760 | 1000+ | 983 | 89 | 373 | 502 | 548 | 494 |
| $C_1$–$C_3$ (SCF/B) | 340 | 254 | 253 | 234 | 253 | 366 | 236 | 200 | 213 | 266 | 367 | 168 | 150 | 109 | 133 |
| $C_3$ Unsaturated (Vol %) | 96 | 67 | 47 | 46 | 53 | 98 | 56 | 44 | 43 | 48 | 100 | 45 | 31 | 18 | 25 |
| $C_4$ Unsaturated | 3.6 | 3.1 | 3.7 | 3.2 | 3.2 | 4.1 | 2.4 | 3.8 | 3.5 | 2.8 | 4.0 | 3.1 | 2.3 | 1.2 | 1.6 |

TABLE 3-continued

| | Effect of Metals Impregnation on Product Yields | | | | | | | | | | | | | | |
|---|---|---|---|---|---|---|---|---|---|---|---|---|---|---|---|
| | Experimental Catalyst No. 1 | | | | | Experimental Catalyst No. 2 | | | | | ROC-1 Commercial Catalyst | | | | |
| (Vol %) | | | | | | | | | | | | | | | |
| iso-$C_4$ (Vol %) | 5.8 | 3.2 | 2.2 | 1.5 | 2.0 | 4.4 | 1.9 | 2.0 | 1.3 | 1.7 | 7.1 | 2.1 | 0.9 | 0.4 | 0.6 |

*Nickel Equivalents = concentration of nickel + ¼ concentration of vanadium (see footnote No. 1)
**Light Cycle Oil boils between 450° F. and 670° F.
*Contains vanadium and no nickel The data in FIG. 1 show that experimental catalyst No. 1 gives a slightly lower conversion than the ROC-1 commercial catalyst but yields considerably higher conversions after impregnation with metals. A comparison of the conversions obtained when the metal content of the two catalysts is about 4750 ppmw Nickel Equivalents indicates that experimental catalyst No. 1 is more than twice as active as the ROC-1 commercial catalyst. The commercial catalyst, which has the highest rare earth content, shows good activity only in the absence of metals. The data set forth in FIG. 2 indicate that experimental catalyst No. 1 gives considerably higher gasoline yields when impregnated with metals than does the ROC-1 commercial catalyst. As expected, these higher gasoline yields lead to lower light cycle oil yields for experimental catalyst No. 1 as indicated by the data set forth in FIG. 3**. The better metal tolerance of experimental catalyst No. 1 compared to the commercial catalyst is attributed to several factors including the relatively high alumina content, the low amount of sodium present, a higher percentage of large pores and the high stability of the LZ-210 zeolite in the presence of metals.

EXAMPLE 2

Another experimental catalyst is prepared as described in Example 1, except no rare earth and ammonium-exchanged LZ-Y-52 zeolite, a nondealuminated zeolite, is included in the formulation. Also, the following amounts of materials are utilized on a dry basis: 875 grams of Catapal alumina, 750 grams of kaolin and 875 grams of ammonium-exchanged LZ-210 zeolite having a silica-to-alumina mole ratio of 9.0. The composition and physical-chemical properties of the spray dried catalyst are set forth in Table 2 under the heading "Experimental Catalyst No. 2." Samples of this catalyst are impregnated with either vanadium alone or combinations of nickel and vanadium as described in Example 1 and then subjected to the standard microactivity test method using the same feedstock and conditions as utilized in Example 1. The results of these tests are set forth in Table 3 under the heading "Experimental Catalyst No. 2." The data for conversion, gasoline yield and light cycle oil yield are also included in the plots of FIGS. 1 through 3.

Figure 2:
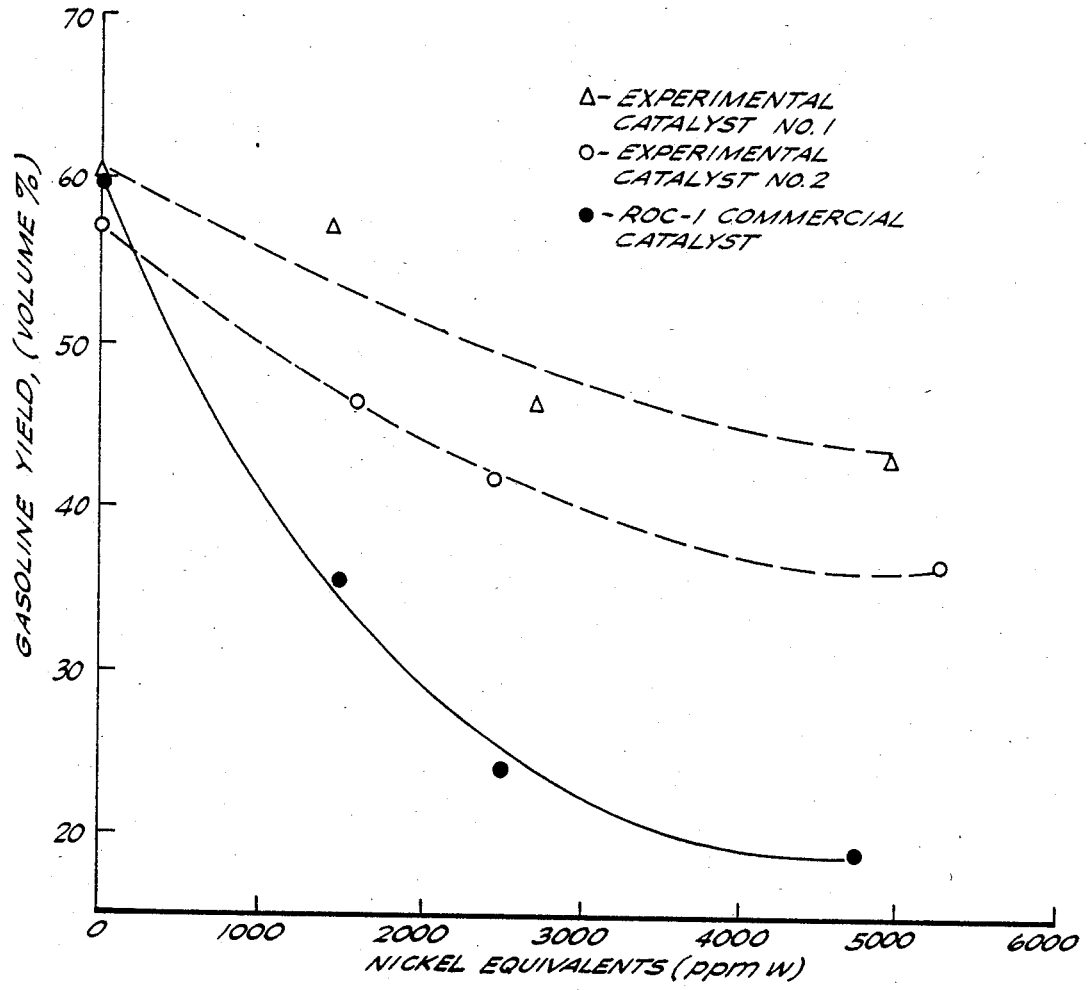
FIG. 2 is a plot comparing the gasoline yield obtained in a catalytic cracking process utilizing experimental catalysts containing varying concentrations of nickel and vanadium to the gasoline yield obtained using a commercially available catalyst containing similar concentrations of nickel and vanadium.
Figure 3:
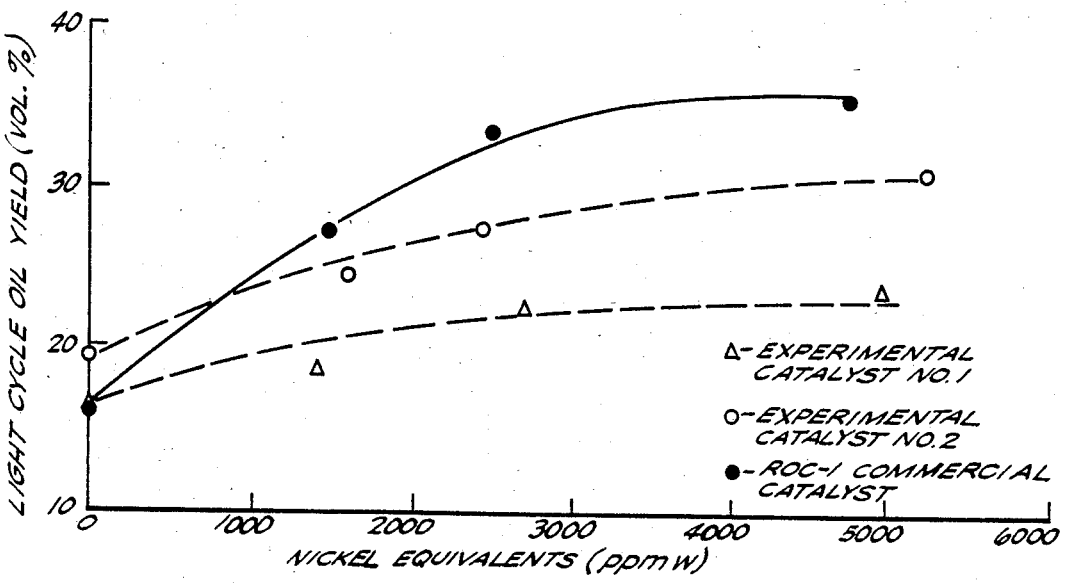
FIG. 3 is a plot comparing the light cycle oil (LCO) yield obtained in a catalytic cracking process using experimental catalyst containing varying concentrations of nickel and vanadium to the light cycle oil yield obtained using a commercially available catalyst containing similar concentrations of nickel and vanadium.

The data for experimental catalyst No. 2 set forth in FIGS. 1 and 2 show that this catalyst, like experimental catalyst No. 1, gives much better conversion and gasoline yields when impregnated with metals than does the ROC-1 commercial catalyst. The conversion and gasoline yields, however, are not as good as those obtained using experimental catalyst No. 1. This is because experimental catalyst No. 1 contains, in addition to LZ-210 zeolite, 10 weight percent of a rare earth-exchanged nondealuminated zeolite that is more active than the LZ-210 zeolite. Even though experimental catalyst No. 2 contains 5 weight percent more total zeolite (see Table 2) than experimental catalyst No. 1, it is not as active. Thus, it appears that preferred catalysts for use in the process of the invention should contain a dealuminated Y zeolite to provide stability or resistance to deactivation by metals in the feedstock plus a lesser amount of a conventional or nondealuminated rare earth-exchanged Y zeolite to boost activity. In cases where it is not desired to use a nondealuminated zeolite in combination with a dealuminated zeolite, the activity of the catalyst can be boosted by using a dealuminated zeolite that has been ion exchanged with rare earth cations.

It will be apparent from the foregoing that the invention provides a process for catalytically cracking metals-containing feedstocks such that the cracking catalyst retains activity and selectivity as the metals concentration of the catalyst increases during the cracking operation. The metals tolerance of the catalyst results in longer run times between catalyst changeovers and the need for less makeup catalyst. These factors in turn result in lower cost operations.

Although this invention has been primarily described in conjunction with examples and by reference to embodiments thereof, it is evident that many alternatives, modifications and variations will be apparent to those skilled in the art in light of the foregoing description. Accordingly, it is intended to embrace within the invention all such alternatives, modifications and variations that fall within the spirit and scope of the appended claims.

I claim:

1. A process for the catalytic cracking of a metals-containing hydrocarbon feedstock which comprises contacting said hydrocarbon feedstock with a cracking catalyst under cracking conditions in the sustantial absence of added molecular hydrogen in a cracking zone to convert components of said feedstock into lower molecular weight constituents, wherein said cracking catalyst comprises (1) a porous, inorganic refractory oxide component in combination with (2) a dealuminated Y zeolite having a silica-to-alumina mole ratio greater than about 6.0, said zeolite having been prepared by contacting a Y zeolite with an aqueous solution of a fluorosilicate salt.

2. A process as defined by claim 1 wherein said hydrocarbon feedstock has a metals concentration greater than about 4.0 ppmw Nickel Equivalents.

3. A process as defined by claim 1 wherein said hydrocarbon feedstock contains greater than about 70 volume percent constituents boiling above about 650° F.

4. A process as defined by claim 3 wherein said hydrocarbon feedstock contains greater than about 20 volume percent constituents boiling above about 1025° F.

5. A process as defined by claim 1 wherein said hydrocarbon feedstock contains greater than about 0.3 weight percent sulfur and said inorganic refractory oxide component comprises greater than about 30 weight percent alumina.

6. A process as defined by claim 1 wherein said porous, inorganic refractory oxide component is selected from the group consisting of alumina, silica, silica-alumina, and natural synthetic clays and mixtures thereof.

7. A process as defined by claim 1 wherein said porous, inorganic refractory oxide component comprises alumina.

8. A process as defined by claim 7 wherein said porous, inorganic refractory oxide component comprises alumina and kaolin.

9. A process as defined by claim 8 wherein said catalyst contains greater than about 30 weight percent alumina.

10. A process as defined by claim 1 wherein said catalyst further comprises a nondealuminated Y zeolite.

11. A process as defined by claim 10 wherein said dealuminated Y zeolite comprises LZ-210 zeolite.

12. A process as defined by claim 10 wherein said nondealuminated Y zeolite has been ion exchanged with rare earth-containing cations.

13. A process as defined by claim 1 wherein said dealuminated Y zeolite has silica-to-alumina mole ratio between about 6.1 and about 10.0.

14. A process as defined by claim 1 wherein said dealuminated Y zeolite is prepared by contacting an amonium-exchanged Y zeolite with an aqueous solution of ammonium hexafluorosilicate.

15. A process as defined by claim 14 wherein said refractory oxide component comprises a mixture of alumina and kaolin.

16. A process as defined by claim 1 wherein said hydrocarbon feedstock is contacted with said cracking catalyst at a temperature between about 800° F. and about 1100° F.

17. A process as defined by claim 16 wherein said dealuminated Y zeolite has a silica-to-alumina mole ratio between about 6.1 and about 15.

18. A process as defined by claim 1 wherein said dealuminated Y zeolite comprises LZ-210 zeolite.

19. A process as defined by claim 1 wherein said 1 cracking catalyst has a metals concentration between about 1000 ppmw and about 10,000 ppmw Nickel Equivalents.

20. A process for the catalytic cracking of a hydrocarbon feedstock having a metals concentration greater than about 4.0 ppmw Nickel Equivalents which process comprises contacting said hydrocarbon feedstock with a cracking catalyst under cracking conditions including a temperature between about 800° F. and about 1100° F. in the substantial absence of added molecular hydrogen in a cracking zone to convert components of said feedstock into lower molecular weight constituents, wherein said cracking catalyst comprises combination:

(a) alumina;
(b) clay;
(c) a delauminated Y zeolite having a silica-to-alumina mole ratio between about 6.1 and about 15, said zeolite having been prepared by contacting an ammonium-exchanged Y zeolite with an aqueous solution of ammonium hexafluorosilicate; and
(d) a nondealuminated Y zeolite having a silica-to-alumina mole ratio below about 6.0.

21. A process as defined by claim 20 wherein said nondealuminated Y zeolite comprises a stabilized hydrogen Y zeolite.

22. A process as defined by claim 20 wherein said nondealuminated Y zeolite comprises a Y zeolite that has been ion exchanged with rare earth-containing cations.

23. A process as defined by claim 20 wherein said clay comprises kaolin.

24. A process as defined by claim 20 wherein said catalyst contains between about 25 weight percent and about 40 weight percent alumina, between about 25 weight percent and about 65 weight percent clay, between about 10 weight percent and about 30 weight percent dealuminated Y zeolite and between about 5 weight percent and about 20 weight percent nondealuminated Y zeolite.

25. A process as defined by claim 20 wherein said dealuminated Y zeolite has a silica-to-alumina mole ratio between about 6.1 and about 10.0.

26. A process as defined by claim 20 wherein said dealuminated Y zeolite has been ion exchanged with rare earth-containing cations.

27. A process as defined by claim 20 wherein said hydrocarbon feedstock has a metals concentration greater than about 10 ppmw Nickel Equivalents.

* * * * *

UNITED STATES PATENT AND TRADEMARK OFFICE

CERTIFICATE OF CORRECTION

PATENT NO. : 4,588,496

DATED : 05/13/86

INVENTOR(S) : Julius Scherzer

It is certified that error appears in the above-identified patent and that said Letters Patent is hereby corrected as shown below:

Column 13, claim 14, line 28, delete "amonium" and insert therefor --ammonium--.

Column 13, claim 19, line 43, after "said" delete "1".

Column 14, claim 20, line 10, after "comprises", insert --in--.

Signed and Sealed this

Seventeenth Day of November, 1987

*Attest:*

DONALD J. QUIGG

*Attesting Officer*

*Commissioner of Patents and Trademarks*